United States Patent [19]

Price

[11] Patent Number: 4,949,557

[45] Date of Patent: Aug. 21, 1990

[54] RELATING TO LAUNDRY MACHINES

[75] Inventor: Wayne L. Price, Auckland, New Zealand

[73] Assignee: Fisher & Paykel Limited, Auckland, New Zealand

[21] Appl. No.: 406,238

[22] Filed: Sep. 12, 1989

[30] Foreign Application Priority Data

Sep. 13, 1988 [NZ] New Zealand ..... 226165

[51] Int. Cl.[5] ..... D06F 23/04; D06F 39/08

[52] U.S. Cl. ..... 68/23.4; 68/208

[58] Field of Search ..... 68/23.4, 208

[56] References Cited

U.S. PATENT DOCUMENTS

| | | | |
|---|---|---|---|
| 2,331,700 | 10/1943 | Kirby | 68/208 X |
| 2,900,812 | 8/1959 | Smith | 68/208 X |
| 2,973,637 | 3/1961 | Sisson | 68/208 X |
| 2,976,998 | 3/1961 | Smith | 68/208 X |
| 3,138,946 | 6/1964 | Amthor, Jr. et al. | 68/23.4 |
| 3,246,837 | 4/1966 | Douglas | 68/23.4 |

FOREIGN PATENT DOCUMENTS

| | | |
|---|---|---|
| 262954 | 12/1926 | United Kingdom . |
| 667456 | 2/1952 | United Kingdom . |
| 846112 | 8/1960 | United Kingdom . |

*Primary Examiner*—Philip R. Coe

*Attorney, Agent, or Firm*—Fleit, Jacobson, Cohn, Price, Holman & Stern

[57] ABSTRACT

A water container (2) of a laundry machine has a helical path (24) in the base (20) thereof starting from a point adjacent to but above a drain inlet and progressing downwardly in the direction of motion of a spin tub (3) rotatable in the water container (2) towards the drain inlet (23).

10 Claims, 4 Drawing Sheets

RELATING TO LAUNDRY MACHINES

FIELD OF THE INVENTION

This invention relates to laundry machines.

BRIEF SUMMARY OF THE INVENTION

It is an object of the present invention to provide a laundry machine which will at least provide the public with a useful choice.

Accordingly in one aspect the invention consists in a laundry machine comprising a cabinet, a washing container within said cabinet, said washing container having a base and an outer wall; a rotatable assembly comprising a spin tub within said container, said spin tub having a base and an outer wall, an agitator within said spin tub; a motor driving said agitator and said spin tub when required; washing liquid admission means; and draining means having an inlet at or below a draining level in said base of said washing container said base having over at least an annular part thereof, a helical path starting from a point adjacent said inlet to said draining means but beyond said inlet in the direction of rotation of said rotatable means, said path increasing the depth of said washing container substantially to said draining level of said inlet the construction and arrangement being such that in use on said rotating means rotating for the purpose of spinning clothes placed in said spin tub, the formation of suds on water passing down said helical path to said draining means inlet is obviated or minimised as the water passes to said draining means.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings in which.

DETAILED DESCRIPTION

The present invention is directed to the reduction of suds in a laundry machine in which clothes are spun rapidly in a spin tub in the known way to remove some water therefrom since suds build up may be such as to inhibit the spin tub reaching an effective spin speed.

It is believed that the causes of suds locking are: (1) The moving fluid hitting stationary components also possibly bouncing back on to rotating parts, e.g. water from the rotating spin bowl hitting vertical vanes on the water container.

(2) Rotating components of the laundry machine hitting stationary fluid, e.g. build up of water in the base of the water container occurs until that water hits the rotating spin bowl.

(3) Waves in shallow water induced by vibration, e.g. when a thin layer of water is present on the water container base and the system is vibrating due to rotation of the rotating assembly.

(4) Insufficient pump performance, e.g.
   (a) low pump out rate
   (b) high inlet pressure head necessary to clear an airlock in the pump
   (c) blockage due to lintage being present in the water being pumped out.

(5) The presence of airflows resulting from rotation of the spin bowl together with any one or more of the above causes. The combination causes significant amplification of suds generation, e.g. through air pumped through the agitator lint filtration pumping system when in the spin mode.

(6) Software routines which command extraction of water from clothing at greater rates than the drainage system can cope with.

Figure 1:
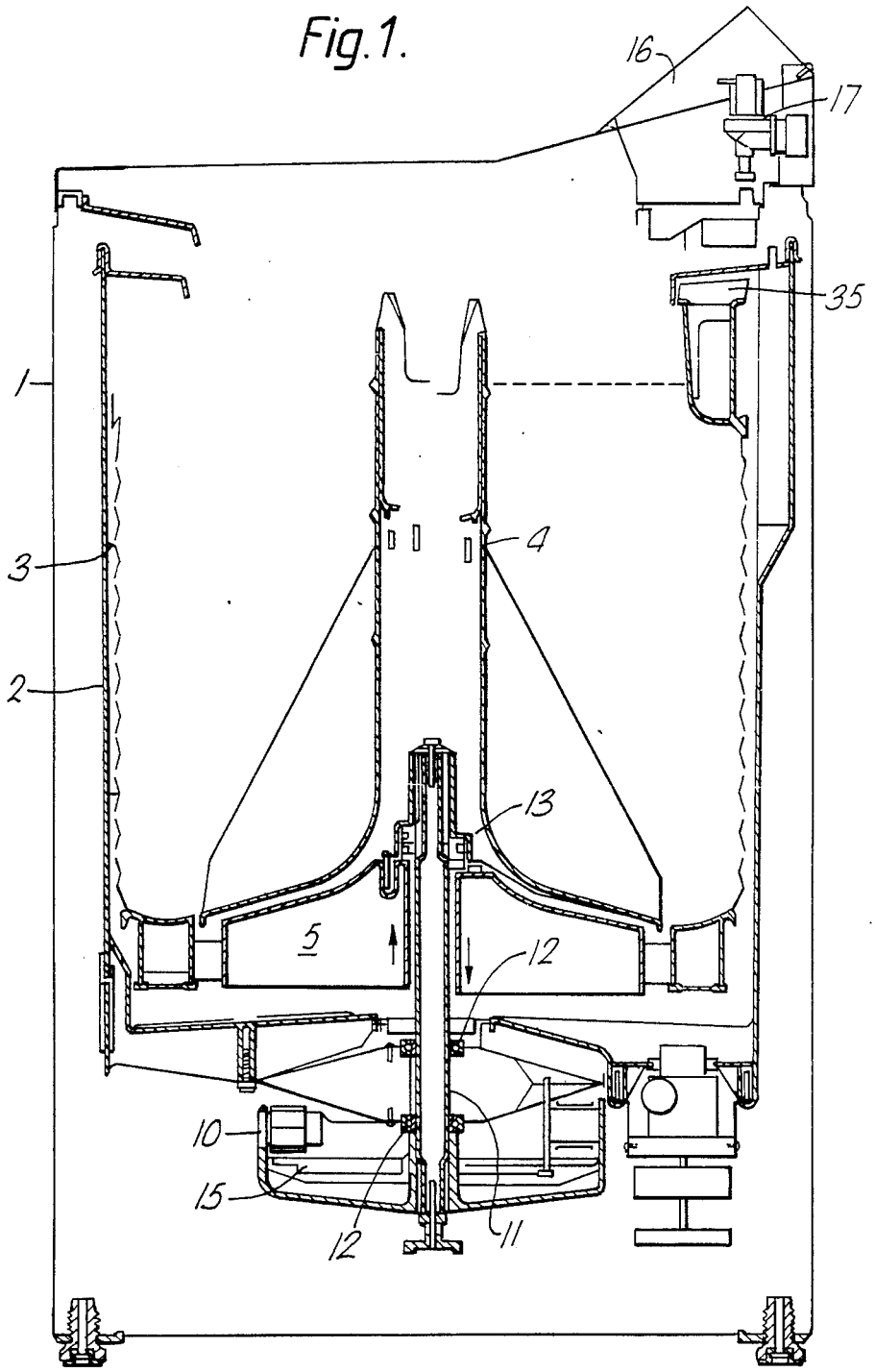
FIG. 1 is a cross sectional drawing of a laundry machine which the invention may be incorporated.

Accordingly in order to eliminate or reduce the effect of at least some of the above causes, the present invention has been devices and referring to the drawings, FIG. 1 illustrates a cross section of a preferred form of laundry machine, a full description of which appears in New Zealand Patent Specification . No. 215389/2171623/218356 and the description of that laundry machine in that specification is incorporated herein by reference.

For the purposes of the present invention the laundry machine comprises a cabinet 1 within which there is a fixed container 2 and within that container is a rotatable spin tub 3 and within the spin tub is an agitator 4. Although not forming part of the present invention an interengagement mechanism is provided to enable the rotatable assembly comprises the spin tub 3 and the agitator 4 to be raised and lowered when water enters the container 1 and such mechanism includes a float shown generally by the reference 5 and is described in the above specification. This equipment is part of the preferred form of laundry machine. The agitator 4 is driven by an electronically commutated motor 10, driving a shaft 11 carried in bearings 12. This construction is fully described in the above New Zealand Patent Specification.

A control means 15 is provided preferably incorporated in or associated with the stator of the motor 10 and such control means include start up control means arranged for appropriate operation of manually operated controls in a console 16 by an operator. On starting up a washing cycle, water is admitted through a valve 17 and the agitator and spin tub are caused to rotate slowly preferably with changes in direction while water is being admitted into the container 2.

Figure 2:
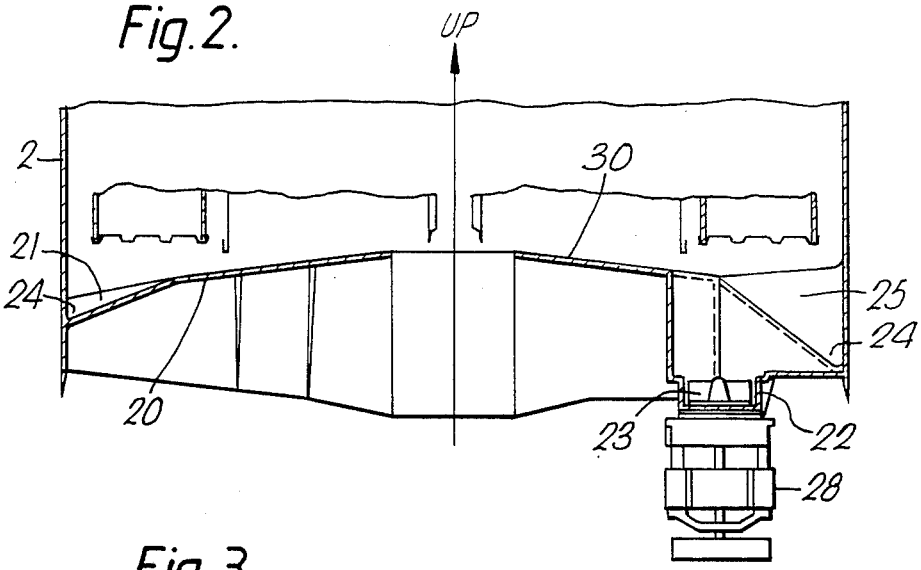
FIG. 2 is a cross section in detail of the lower end of a water container of the machine of FIG. 1.
Figure 3:
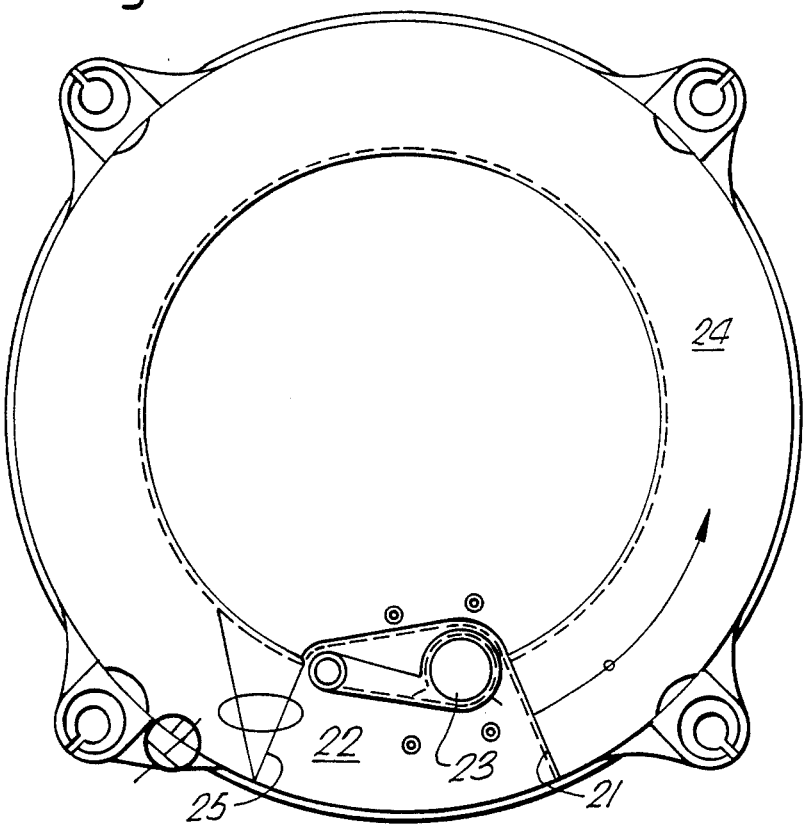
FIG. 3 is an underneath view of the water container of FIG. 2.
Figure 4:
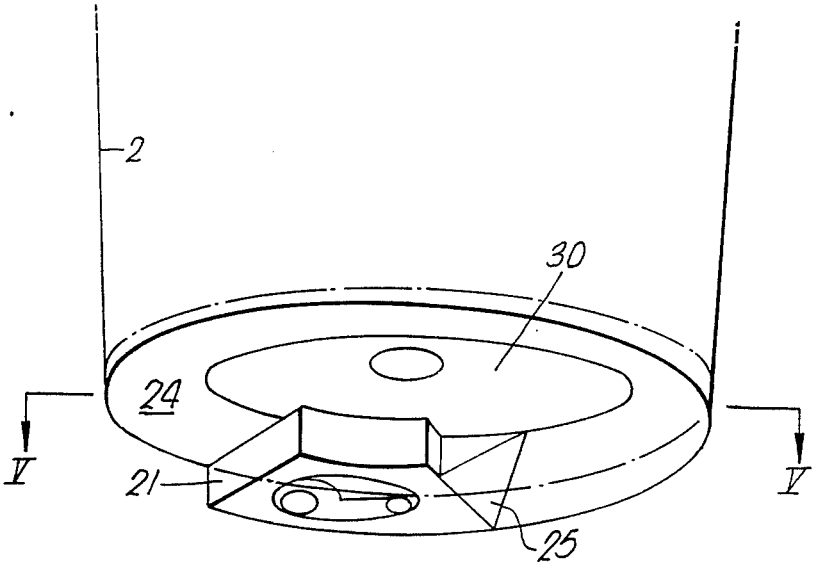
FIG. 4 is a perspective sketch showing the arrangement of the invention.
Figure 5:
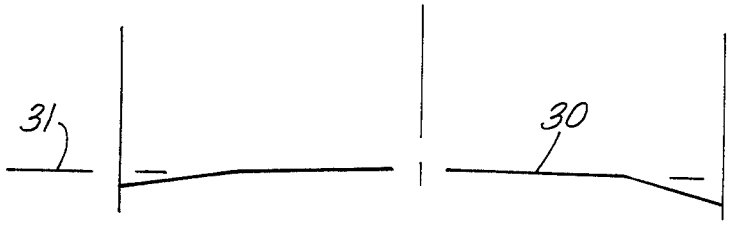
FIG. 5 is a diagrammatic cross sectional section on the line V—V of FIG. 4.

The above apparatus is modified according to the present invention by providing in the base 20 (FIG. 2) of the container 2 a helical annular path 24 in the form of a depression which increases in depth in the direction of rotation of the spin tub 3, from a transverse wall which is on the edge of a sump 22. The sump 22 has an outlet 23 to a drain pump 28, and the pump has an outlet hose (not shown) leading away to waste. The path 24 leads downwardly to a slope 25 on the opposite side of the sump 22 as shown in FIG. 3. As may be seen from FIG. 4, the wall 21 is substantially vertical but the slope 25 has a steeper slope than that of the helical annular path 24. As may be seen from FIG. 2, the path 24 is formed as a frustum of a cone sloping downwardly outwardly, the core increasing in slope between the start of the helical path and the end of the helical path. The central part 30 of the base 20 is a shallow central cone sloping downwardly and outwardly as may be seen in FIG. 5.

In operation, after a washing cycle and draining of a major proportion of water from the water container have been effected, spinning of the spin bowl is commenced in stages with tests being made to ensure that the load on the motor is not too great before increases in spinning speeds are made. During the preliminary stage of spinning a considerable amount of detergent laden water is removed by centrifugal force from the clothes in the spin tub and such water passes down the wall of the spin tub 3 into the helical path 24. The shape of the pathway and its formation is such that only a thin film of water tends to collect in the pathway, the flow of water towards the drain sump being assisted by gravity and by airflow caused by rotation of the spin tub.

The apparatus above described has been tested and has provided useful results. The pump 28 is positioned as low down as possible, and the helical path mounted outward of the cone 30, with the lowest point at any particular cross section of the path 24 adjacent the wall of the water container 2. The helical path 24 increases the vertical clearance between the water container 2 and the spin tub 3 and this clearance gives an increase in volume as the path progresses towards the sump. This reduces water surging, acting as a buffer for such surging.

The test machine was initially run with no vertical or horizontal vanes and without a sump stopper vane as it was supposed that the abrupt wall 21 to the helical path would serve the same purpose. Results of the tests showed a marked improvement in suds lock performance and the machine was capable of handling 12 caps of DYNAMO (Trade Mark) detergent for the full three minutes of spray rinse. This performance is equivalent to an older machine's capability of 8 caps of DYNAMO detergent.

Figure 6:
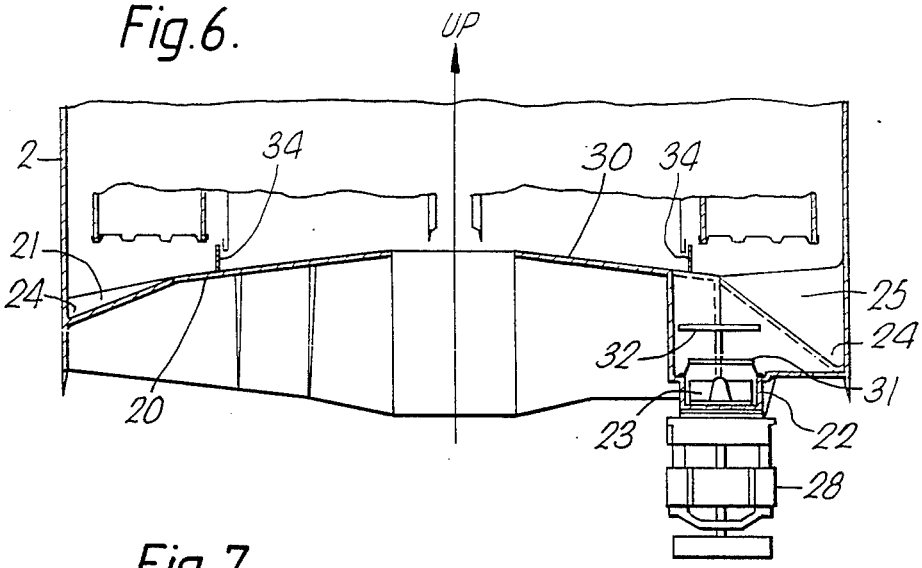
FIG. 6 and 7 are similar to FIGS. 2 and 3 respectively but with additions thereto
Figure 7:
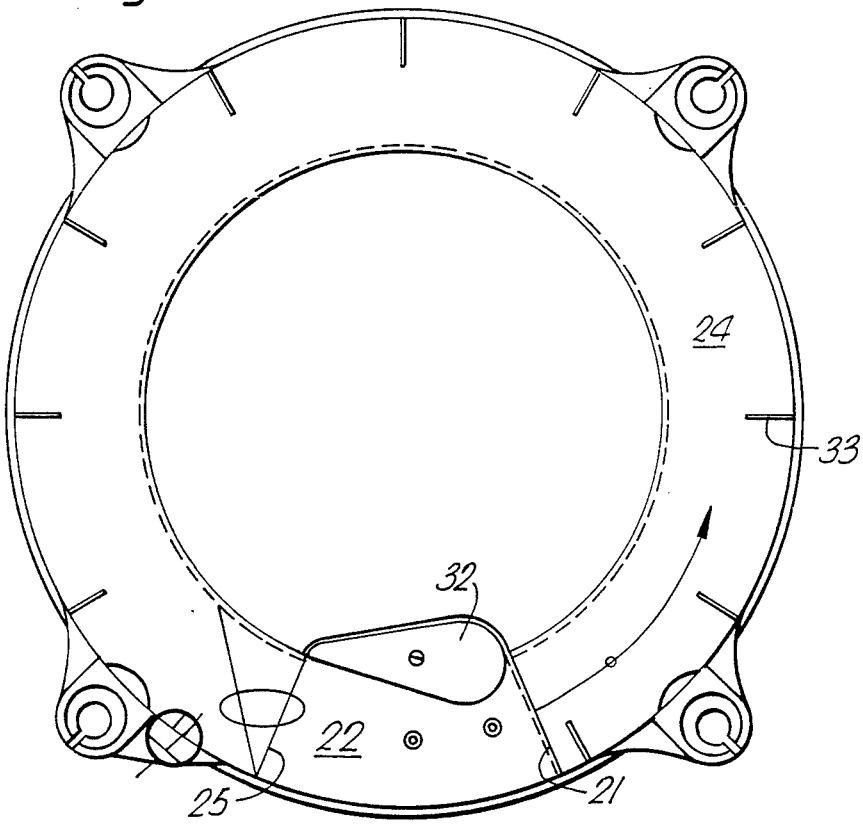

Modifications to the simple machine above described are as follows:

1. A sector shaped cover 32 (FIG. 6) on the sump used in the test machine may be provided if desired.
2. An inwardly positioned labyrinth seal 34 FIG. 6 between the water container base and a lower part of the spin tub may also be provided if desired.
3. The depth and width of the helical path are not believed to be critical. An optimum clearance of the spin tub from the necessary dimensions of the container base may be established by experimentation.

4 A pump cover 31 and the sump should be such as to leave no water in the bowl after pumping and the shape of the sump inward of the conical section 30 shown in the drawings is not essential.

It is believed that the helical path system above described performs satisfactorily because:

1. The arrangement above described generally results in the absence of a continuous annular free water surface for generation of waves due to orbital vibrations.
2. No turbulence generators for fluid flow, e.g. vanes and similar obstructions to flow are provided.
3. In some circumstances however vanes may be provided to decrease velocity with a combination of helical increase in volume with rotation and by use of the wall 25 at the end of the path.
4. It is believed that there is
   (a) favourable pressure distribution around the water container base caused by Bernoulli effect. Thus at the beginning of the path there is a V+ i.e. high velocity component in the air and water flows with a consequent P- or low pressure being present while as the path approaches the sump the velocity decreases and the pressure increases.
   (b) a pressurised boundary layer of air on the surface of water under the rotating spin tub which tends to repel suds and drive detergent foam back into the water as the water runs to the sump, causing such detergent foam to go back into solution. Thus the suds level does not build up to reach the base of the spin tub.
   (c) an increase in the natural discharge towards the pump due to gravity which increases the water removal efficiency and reduces total time available for the solution of water and detergent to turn into suds.
   (d) the increased volume under the spin tub acts as a buffer for surges in water extraction from clothes during rapid acceleration and to compensate for any pulsing of the flow of washing liquid through the pump.

Referring to the believed causes 1 to 6 set forth above, it is believed that the following modifications may be made to inhibit rotation of washing liquid with the spin tub.

1 Inhibiting Rotating fluid. Components which may assist comprise

Vanes 33 running up the vertical walls of the water container in the region of the spin tub. Such vanes may be vertically disposed (as shown) or disposed at an angle to the vertical so that both gravity and centrifugal forces assist in causing the washing liquid to run down the vanes.

These parts are required to prevent fluid rotation but require optimisation of various speeds to prevent suds production.

2. Modifications to provide optimum operating conditions include
   (a) Spin tub to water container clearances vertical and axial require careful consideration and testing
   (b) The spin tub base shape is designed to match water profiles
   (c) The water outlet flow rate from the spin tub is matched against the pump out rate, i.e. the pump out rate should be such that there is no net build up of water in the sump during the spinning phase.

(3) The creation of waves requires control. Factors involved in creation of waves and methods of control of such factors are (a) The minimum head at which the pump will clear an air lock should be such that the minimum head is less than the sump depth.

(b) A volume of air space available above water surface in the sump and the path at the head which gives air lock clearing are selected to compensate for response time of pump to head when water is being extracted from clothes at a high rate.

(c) Vibration levels are controlled by determination of the dynamic system, used e.g. balance ring configurations, as affected by clothes out of balance, and spin speeds relative to resources.

(d) Square or sharp corners which run circumferentially around the water container base and cause splashing of waves when they are hit by them, are preferably avoided, i.e. rounded corners are more desirable.

(e) The cross sectional vertical high profiles of the water container should be deepest at outer radii to reduce wave formation.

4. Pump selection Pump out performance is governed as follows (a) Pump power and speed of impeller fixed by design.

(b) Impeller type, two bladed impeller chosen for lint performance.

(c) Pump cover design to give good efficiency.

(d) Pump cover inlet design optimisation should consider ability to allow air to escape backward or a low pressure region of the impeller (air lock clearing) should be provided. Vortex generation and air mixing should be minimised for low head. The pump sump shape should be designed for free flow, e.g. maximum depth at the inlet, ability to stop and trap moving water and outlet hose friction should be minimised e.g. quadraflex hose offers considerable friction.

5. Air Flows. Parts of the system relative to the mechanism and solutions are (a) To prevent or limit air being pumped during a spin cycle through any agitator lint filtration system provided; a labyrinth seal is provided between the water container and the outer lower surface of the spin tub consisting of annular rings which seal in spin but which are open in agitation.

(b) Turbulence may be generated by radial components such as strengthening ribs in open sections of the spin tub which rotate immediately above the outer bowl base. The solution is to minimise these projections by keeping the spin tub base as smooth as possible. The turbulence seems to cause confusion to the wave mechanism mentioned in 3 above.

(c) Control of the flow of air which is centrifuged through the clothes with water, is not a large problem but should be guarded against.

(d) Any of the above flows which occur in the opposite direction to desired water flows will inhibit water from reaching the pump. The effect is best minimised by the design of a neck ring system which restricts air flow at the outlet end, e.g. a labyrinth seal on the neck ring which is not affected by e.g. the floating bowl system used in the preferred form, or perhaps a blow back fan 35 system of vanes mounted on the spin tub balance ring.

6. Software Routines. Various aspects of the software routine which must be considered for suds lock performance are (a) Tuning of the software to suit the mechanical performance limitations of the machines.

(b) Attempts should be made to achieve maximum possible water extraction from clothes at speeds below 150 rpm (limited by rocking resonance) as most of the phenomena mentioned occur above this speed.

(c) Maximum possible acceleration rates are required between 150 rpm and 250 rpm as dictated by the requirement to accelerate through rocking resonance as quickly as possible. Unfortunately this frequently causes a surge in water extraction.

(d) Once the 250 rpm speed is reached, a spray rinse should be started immediately before the pump air locks.

(e) Spray rinse inlet water flow should be limited to less than pump flow rate for the pump while the bowl is spinning at 250 rpm and there is a minimum priming head.

(f) If under speed occurs for a set current limit on the motor, the machine should immediately switch to a suds lock recovery deep rinse before returning to spray rinse. It should be repeated three times before the software goes to a faulting instruction.

(g) At the end of the spray rinse increase to higher speeds should be effected in a controlled manner so as not to cause excessive surges of water extraction.

(h) The total spray rinse time may be determined and optimised by the software for the wash load if this load can be determined by the software during the fill of water for agitation.

(i) The machine may perform a normal cycle once it has passed through the complete spray and deep rinse routines.

It is noted that it is best to reduce suds lock tendencies by reducing the use of detergent by providing an easily operated chute and/or to produce measure/dispenser systems which should be incorporated in any design.

It will be seen from the foregoing that the reduction of suds locking in a laundry machine requires careful design and it is believed that with the present invention the tendency to suds lock is substantially reduced.

I claim:

1. A laundry machine comprising a cabinet, a washing container within said cabinet, said washing container having a base and an outer wall; a rotatable assembly comprising a spin tub within said container, said spin tub having a base and an outer wall, an agitator within said spin tub; a motor driving said agitator and said spin tub when required; washing liquid admission means; and draining means having an inlet at or below a draining level in said base of said washing container, said base having over at least an annular part thereof a helical path starting from a point adjacent said inlet to said draining means but beyond said inlet in the direction of rotation of said rotatable means, said path increasing the depth of said washing container substantially to said draining level of said inlet, the construction and arrangement being such that in use on said rotating means rotating for the purpose of spinning clothes placed in said spin tub, the formation of suds on water passing down said helical path to said draining means inlet is obviated or minimized as the water passes to said draining means.

2. A laundry machine as claimed in claim 1 wherein a steeply rising wall is provided between a sump in which said inlet to said draining means is positioned and the beginning of said helical path.

3. A laundry machine as claimed in claim 2 wherein a sector shaped cover is provided on said sump.

4. A laundry machine as claimed in claim 2 wherein a steeper slope than the slope of the helical path is provided between the end of the helical path and sump.

5. A laundry machine as claimed in claim 1 wherein said helical path is formed as a frustum of a cone sloping downwardly outwardly towards said outer wall.

6. A laundry machine as claimed in claim 1 wherein a central part of said base is formed as a shallow core sloping downwardly outwardly.

7. A laundry machine as claimed in claim 1 wherein an inwardly position labyrinth seal is provided between said water container and an outer lower surface of said spin tub.

8. A laundry machine as claimed in claim 1 wherein inwardly facing vanes are provided on said outer wall of said spin tub.

9. A laundry machine as claimed in claim 8 wherein said vanes are substantially vertical.

10. A laundry machine as claimed in claim 1 wherein radial vanes are provided on the base of the water container and the spin tub.

* * * * *